United States Patent [19]

Yasuga

[11] Patent Number: 4,693,232

[45] Date of Patent: Sep. 15, 1987

[54] TILE-CUTTING MACHINE

[76] Inventor: Masaki Yasuga, 21-Go, 15-Ban, Minami 3-chome, Oimazato-Higashinari, Osaka, Japan

[21] Appl. No.: 850,762

[22] Filed: Apr. 11, 1986

[51] Int. Cl.[4] ..... B28D 1/32

[52] U.S. Cl. ..... 125/23 T; 225/96.5

[58] Field of Search ..... 125/23 R, 23 T; 225/96.5

[56] References Cited

U.S. PATENT DOCUMENTS 4,026,262 5/1977 Yasuga ..... 125/23 T 4,175,684 11/1979 Butler ..... 225/96.5

FOREIGN PATENT DOCUMENTS 229108 2/1925 United Kingdom ..... 125/23 T

*Primary Examiner*—Harold D. Whitehead

*Attorney, Agent, or Firm*—Ratner & Prestia

[57] ABSTRACT

A tile-cutting machine consists of a main base on which the tile is placed, a guide rail mounted on the base, a handle on the guide rail so that it can move freely along the guide rail and has a part which presses upon the tile on its bottom end, a knife holder with a sliding part which is fixed to the handle by an axle and fits on the guide rail, and a cutting knife which is fixed to the bottom part of the knife holder by an axle. After inscribing a cutting line on the top surface of the tile, the tile is cut along the cutting line.

6 Claims, 4 Drawing Figures

TILE-CUTTING MACHINE

BACKGROUND OF THE INVENTION

A. Field of the Invention

This invention relates to a tile-cutting machine and, in particular, a tile-cutting machine which cuts tile by pressing both sides of a cutting line after the cutting line is inscribed on the tile.

Background Art

When tile is cut to a required width, a cutting line is inscribed on the tile surface by, for example, a diamond knife or super-hard knife, and both sides of the tile are pressed along this cutting line to cut the tile. However, if the accuracy of this cutting line is poor, e.g., if the cutting line is not inscribed straight, the cut surface takes on a poor appearance, with an uneven sawtooth-like look because the pressing force used to cut the tile is increased. Hence, a highly accurate cutting line is required.

Conventional machines for cutting tile to required dimensions consist of a base on which the tile to be cut is placed; a guide rail placed parallel to the base surface; a handle for cutting the tile which is placed on the guide rail so that the handle can swing and slide freely along the guide rail. Conventional machines also include a tile-pressing part and a cutting knife on both sides of its end, sliding plates with small resistance to friction in positions opposite to both sides of the above-mentioned guide rail, and adjustment bolts which maintain narrow gaps between the sliding plates and the sides of the guide rail and allow the handle to slide along the rail without shaking.

By sliding the handle and pressing the cutting knife on the upper surface of the tile, a cutting line is inscribed at the desired position on the tile surface. Both sides of the tile are then pressed along this cutting line by the tile-pressing part of the above-mentioned handle to cut the tile. See, for example, U.S. Pat. No. 4,026,262 issued to Yasuga on May 31, 1977.

The structure of conventional tile-cutting machines is therefore complex and expensive to construct, and its durability is poor. Unless the sliding width is adjusted frequently, accuracy cannot be maintained. Assembly and adjustment are difficult and the efficiency of the manufacturing operation is poor.

SUMMARY OF THE INVENTION

A tile-cutting machine consists of a main base on which the tile is placed, a guide rail mounted on the base, a handle on the guide rail so that it can move freely along the guide rail and has a part which presses upon the tile on its bottom end, a knife holder with a sliding part which is fixed to the handle by an axle and fits on the guide rail, and a cutting knife which is fixed to the bottom part of the knife holder by an axle. After inscribing a cutting line on the top surface of the tile, the tile is cut along the cutting line.

DETAILED DESCRIPTION OF THE INVENTION

Figure 2:
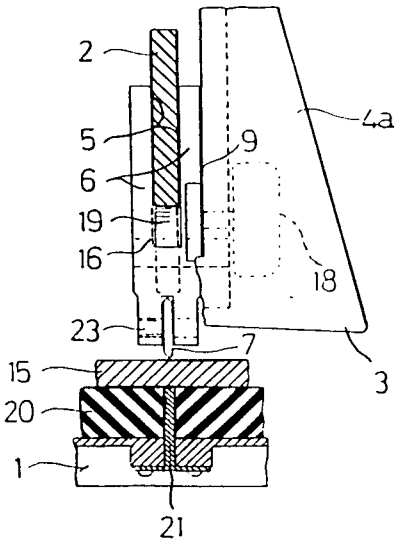
FIG. 2 is a vertical cross-section of the tile-cutting machine of FIG. 1.
Figure 1:
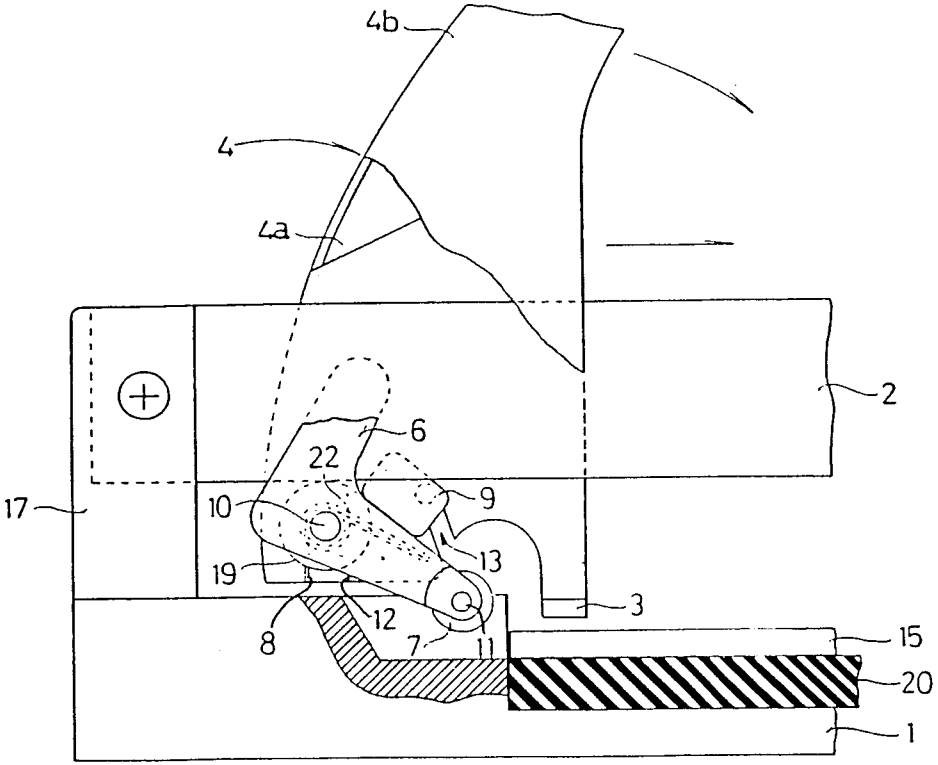
FIG. 1 shows a side view, partially cut away, of the tile-cutting machine of the present invention.
Figure 3:
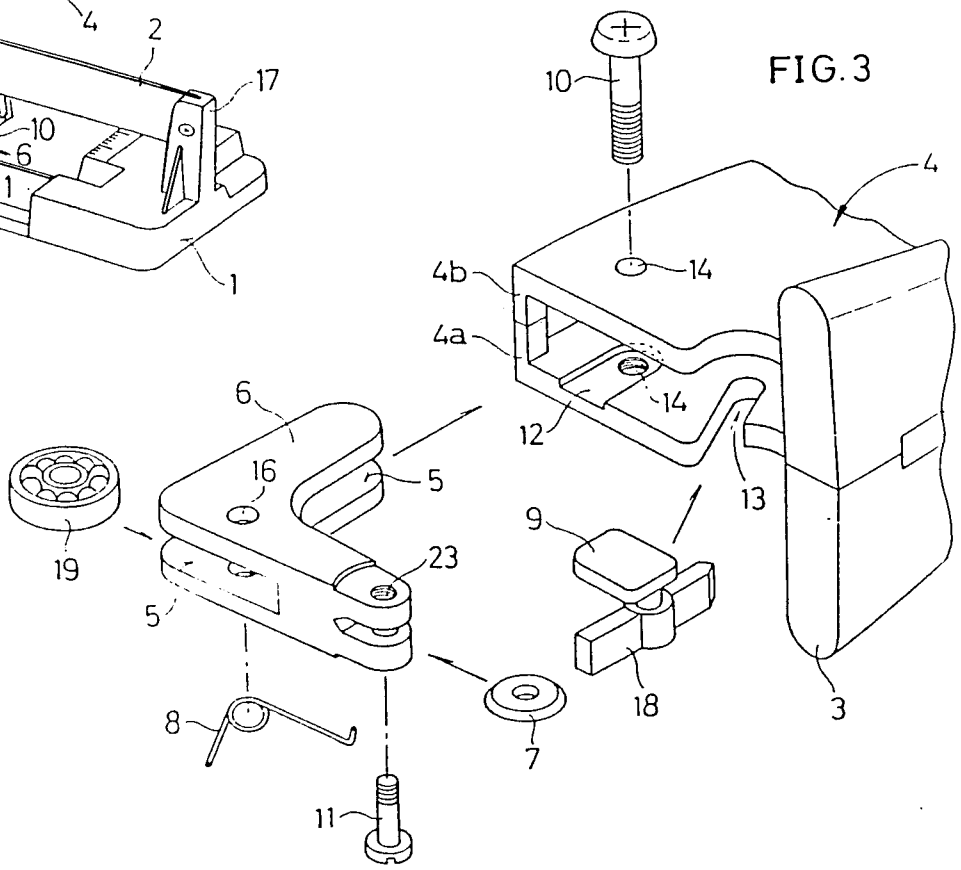
FIG. 3 is an exploded perspective view of a portion of the tile-cutting machine of FIG. 1; part.
Figure 4:
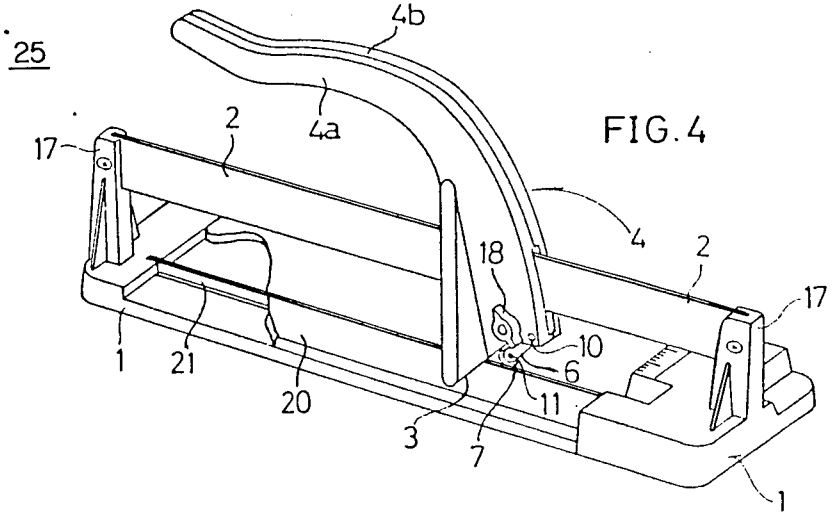
FIG. 4 is an additional perspective view of the tile-cutting machine of FIG. 1.

Referring now to FIG. 1, tile-cutting machine 25 is shown. Knife holder 6 of tile-cutting machine 25 is pushed upward by elastic body 8 and contacts eccentric cam 9 on handle 4. The height of cutting knife 7, rotatably fixed to knife holder 6, may be adjusted by rotating eccentric cam 9. Thus, tile-cutting machine may be adjusted to variations in the thickness of tile 15. Tile 15 is placed on main base 1.

The gap between sliding part 5 of knife holder 6 and rail 2 for attaching knife holder 6 to handle 4 can be freely adjusted by tightening axle 10.

By this means, when a gap is produced between sliding part 5 and guide rail 2 by friction, as tile-cutting machine 25 is used over a long period, by tightening the main body axle 10, the above-mentioned gap can be eliminated, and highly accurate cutting lines may be inscribed more consistently, thus improving durability.

Furthermore, in tile-cutting machine 25, part of elastic body 8 is held so that at least one end, attached to handle 4, is inserted into concavity 12 open to the outside. Thus, after knife holder 6 is inserted into handle 4 so that one end of elastic body 8 coincides with concavity 12, main body axle 10 can be inserted and held, and knife holder 6, which is held up can be easily assembled without regard to the form of handle 4, i.e., without regard to whether handle 14 is molded as a single body by resin molding or other means, or whether it is divided into two left and right handle parts **4*a* and 4*b***, which are put together beforehand by screws, for example.

Knife holder 6 by which cutting knife 7 is held includes sliding part 5 which fits on guide rail 2. By means of knife holder 6, cutting knife 7 can be used while being directly guided by guide rail 2 without regard to shaking of the whole handle 4, to inscribe an accurate cutting line on tile 15 while pressing down on tile 15 and moving along it.

Moreover, compared to conventional sliding parts formed on the handle by attaching separate sliding plates to a synthetic resin, etc., handle using set screws, etc., so that they enclose the guide rail on the left and right, sliding part 5 of the knife holder 6 of this invention is molded beforehand to fit directly over guide rail 2; its structure is simple, and it is unnecessary to adjust it during assembly.

The dimensions of main base 1 of tile-cutting machine 25 must conform to the dimensions of tiles 15 to be cut. Base 1 includes support posts 17 on opposite ends.

Guide rail 2 may be formed of metal and is held between the upper portions of support posts 17.

Handle 4 is disposed on guide rail 2 in such a way that guide rail 2 is enclosed by right handle part **4*a* and left handle part 4*b* of handle 4. Handle 4 incorporates tile pressing part 3 at its bottom end. The bottom of handle 13** is formed as two gradually downward inclining planes, one to the left and one to the right.

Moreover, the bottom end of handle 4 has a pair of attachment holes 14 and at least one concavity 12 is formed on handle 4. Concavity 12 is open to the bottom of handle 4 and continuous with the inside end surface of one of attachment holes 14. An open notch 13 is also provided in handle 4. Open notch 13 is placed so that it holds eccentric cam 9 in a manner which permits eccentric cam 9 to revolve and engage and disengage.

Knife holder 6 is formed in an elbow shape and main body axle hole 16 is placed in the central part of holder 6. Sliding part 5 is incorporated in the upper part of knife holder 6. Knife holder 6 is held to attachment holes 14 of handle 4 by means of the main body axle 10, so that it is free to move. Sliding part 5 has a slot formed in it beforehand which substantially corresponds to the thickness of guide rail 2 and fits on guide rail 2 so that it can move freely along rail 2.

Additionally, knife holder 6 has a cutting knife 7 attached to knife attachment hole 23 in its bottom part by knife axle 11, so that knife 7 is free to revolve. In its outer surface, a groove 22 is cut in which one end of elastic body 8 is buried. The other end of elastic body 8 is engaged with the above-mentioned concavity 12 of handle 4, so that knife holder 6 is held up, with main body axle 10 as the center. Thus, attached cutting knife 7 is always held up toward guide rail 2.

Eccentric cam 9 is placed in open notch 13 of handle part 4*a*. Eccentric cam 9 contacts knife holder which is held up, and by rotating cam handle 18 with the fingers, one can change the eccentric distance of this contact and adjust the height of the position of cutting knife 7.

Bearing 19 is held by main body axle 10. The outer circumference of bearing 19 contacts the bottom edge of the guide rail 2 and slips along it, so that knife holder 6 slides more smoothly during the operation of inscribing the cutting line on tile 15.

Receiver 21 is placed beneath the position in which the said knife 7 slides. Receiver 21 consists of a metal plate bent into an upside-down "T" shape and held by main base 1.

Rubber base 20 is placed on the body of main base 1, on either side of receiver 21 and tile 15 to be cut is placed on the upper surface of rubber base 20. Handle 4 is lowered and pressed onto the upper surface of the tile 15 and moved, so that knife 7 is pressed down and the cutting line is inscribed.

After the cutting line is inscribed, tile pressing part or projection 3 of handle 4 contacts tile 15 and the handle is pressed down again. In this way, the tile can be cut along receiver 21, i.e., along the cutting line.

Tile cutter 25 of the present invention is not limited to the above-described actual example; for example, handle 4 may be divided completely into two parts, or the lower half may be divided into two parts and held together by set screws, or it may be molded into one indivisible body made of synthetic resin, etc., and knife holder 6 may be divided into two parts vertically, i.e., parallel to sliding part 5, and formed into one body beforehand by set screws, etc.

Tile cutter 25 has a knife holder to which the cutting knife is attached, which has a sliding part incorporated within it which fits onto the guide rail. In this way, the cutting knife is guided directly along the guide rail, so that there are no other connecting parts interposed which could form an unreliable structure, and it is possible to inscribe a more accurate cutting line.

Moreover, since the sliding part is formed beforehand to substantially fit onto the guide rail, the structure is simple and can be manufactured accurately and inexpensively. In addition, no adjustment of the sliding part is required during manufacturing or during maintenance and replacement and it can be easily assembled.

Furthermore, since the accuracy of tile-cutting machine 25 is determined only by the relationship between guide rail 2 and sliding part 5 of the main body of knife holder 6, the durability can be increased and it can be easily made firm by tightening axle 10. Moreover, it has the effect that one can select the material and the strength of the handle, etc., at will.

In summary, 1 is the mainbody of the base; 2 is the guide rail; 3 is the tile pressing part; 4 is the handle; 4*a* is the right handle part; 4*b* is the left handle part; 5 is the sliding part; 6 is the knife holder; 7 is the cutting knife; 8 is the elastic body; 9 is the eccentric cam; 10 is the main body axle; 11 is the knife axle or knife axis; 12 is the concavity; 13 is the open notch; 14 is the attachment hole; 15 is the tile; 16 is the main body axle hole; 17 is the support post; 18 is the receiver; 22 is the engagement groove; and 23 is the knife attachment hole.

It is claimed:

1. A tile-cutting device comprising a base for supporting a tile, an upright post at each end of said base, a guide rail extending between and supported by said posts above said base, and a lever handle having at its lower end a cavity through which said rail passes, said tile-cutting device characterized by the provision of:

a. an elbow member having first and second arms disposed at an angle relative to each other, said first arm being bifurcated having two branches extending upwardly into the handle cavity between said handle and said rail, one branch on each side of said rail;

b. means at the apex of said elbow member securing said elbow member pivotally to said handle; and c. a cutter at the lower end of said second arm.

2. A tile-cutting device according to claim 1 characterized in that bias means are provided for biasing said cutter upwardly.

3. A tile-cutting device according to claim 2 wherein said bias means is a spring having one end lodged in a slot in said handle and the other end engaged with said second arm of said elbow member.

4. A tile-cutting device according to claim 1 characterized by the provision of an eccentric cam positioned to engage said second arm of said elbow member and by the provision of means for adjusting the position of said eccentric cam thereby to adjust the position of said cutter relative to said base.

5. A tile-cutting device according to claim 1 wherein said lever handle is provided with a pair of winged members, one on each side of said handle, positioned for pressing down on said tile when said lever handle is pressed downwardly.

6. A tile-cutting device according to claim 1 wherein said means securing said elbow member pivotally to said handle includes means for adjusting the spacing between said rail and said branches of said bifurcated first arm of said elbow.

* * * * *